US005473275A

United States Patent [19]

Hughes et al.

[11] Patent Number: 5,473,275

[45] Date of Patent: Dec. 5, 1995

[54] SWITCHED-CURRENT BILINEAR INTEGRATOR SAMPLING INPUT CURRENT ON BOTH PHASES OF CLOCK SIGNAL

[75] Inventors: John B. Hughes, Hove; Kenneth W. Moulding, Horley, both of Great Britain

[73] Assignee: U.S. Philips Corporation, New York, N.Y.

[21] Appl. No.: 302,580

[22] Filed: Sep. 8, 1994

[30] Foreign Application Priority Data

Sep. 8, 1993 [GB] United Kingdom ..... 9318640

[51] Int. Cl.[6] ..... G06G 7/64

[52] U.S. Cl. ..... 327/336; 327/344; 327/345; 327/337

[58] Field of Search ..... 327/94, 95, 96, 327/91, 141, 336, 337, 344, 345; 341/143, 144, 158

[56] References Cited

U.S. PATENT DOCUMENTS

| | | | |
|---|---|---|---|
| 3,812,386 | 5/1974 | Porter . | |
| 4,331,894 | 5/1982 | Gregorian et al. | 307/520 |
| 4,366,468 | 12/1982 | Yoneyama | 340/347 NT |
| 4,653,017 | 3/1987 | Colbeck et al. | 364/825 |
| 4,737,723 | 4/1988 | Mita | 328/120 |
| 5,081,373 | 1/1992 | Suzuki | 307/353 |
| 5,109,169 | 4/1992 | Hughes | 307/490 |
| 5,349,245 | 9/1994 | Hughes et al. | 307/353 |

OTHER PUBLICATIONS

"A 5th Order Bilinear Elliptic Switched–Current Filter" by N. C. Battersby and C. Toumazou, IEEE Custom Integrated Circuits Conference, pp. 63.1–6.3.4. Mar. 1993.

"A 5th Order Bilinear Switched–Current Chebyshev Filter", I. Song and G. W. Roberts, IEEE International Symposium on Circuits and Systems, pp. 1097–1100. Jun. 1993.

*Primary Examiner*—Timothy P. Callahan
*Assistant Examiner*—Kenneth B. Wells
*Attorney, Agent, or Firm*—Bernard Franzblau

[57] ABSTRACT

A switched current bilinear integrator comprising interconnected current memory cells (M1, M2) in which, during a first phase of a clock cycle, an input current is fed to the inputs of the current memory cells and during a second phase of the clock cycle an inverted version (A1) of the input current is fed to the inputs of the current memory cells. The output of the integrator is obtained by combining the output (optionally scaled) of the first current memory cell (M1) with an inverted (A2) version of the output (optionally scaled) of the second memory cell (M2). A lossy integrator may be formed by feeding back to the input a scaled version of the current stored in the second current memory cell and an inverted, scaled version of the current stored in the first memoy cell.

20 Claims, 4 Drawing Sheets

SWITCHED-CURRENT BILINEAR INTEGRATOR SAMPLING INPUT CURRENT ON BOTH PHASES OF CLOCK SIGNAL

BACKGROUND OF THE INVENTION

This invention relates to an integrator using the switched current technique.

Switched current circuits are disclosed in a book entitled "Switched-Currents an analogue technique for digital technology" edited by C. Toumazou, J. B. Hughes and N. C. Battersby published by Peter Peregrinus, ISBN 0 86341 294 7.

First order filter building blocks which perform the bilinear z-transform have well known advantages. Unlike Euler integrators, they have no excess phase and so map to the z-plane with guaranteed stability giving the resulting filter a distortion free amplitude response, even in filters with clock frequencies approaching the Nyquist frequency. This makes the bilinear integrator especially suitable for high frequency filters.

In the past the difficulty of making switched capacitor bilinear z-transform integrators has led to the use of LDI techniques to produce biquadratic sections with bilinear mapping. While a similar approach is adopted for active ladder filters the simulation of the terminations is only approximate. Consequently, an integrator/summer which can perform true bilinear z-transformation is highly desirable.

Several switched current bilinear z-transform integrators have been proposed; for example that shown in the book edited by Toumazou, Hughes and Battersby at page 48. An alternative bilinear z-transform switched current integrator is disclosed in a paper by I. Song and G. W. Roberts entitled "A fifth order bilinear switched current Chebyshev filter" which was presented at the IEEE International Symposium on Circuits and Systems in 1993 and published in the Conference Proceedings at pages 1097 to 1100.

The common factor of all switched current bilinear z-transform integrators previously known to the inventors is that they operate with only one sample per clock period. In addition, all except the Song and Roberts integrator are single ended circuits and require current mirrors to produce signal inversion. Unfortunately these, mirrors introduce excess phase errors and to keep these errors small the clock frequency must be made large compared with the filter cut off frequency, thus nullifying one of the major advantages of bilinear mapping.

SUMMARY OF THE INVENTION

It is an object of the invention to enable the provision of a switched current integrator building block which performs bilinear z-transformation without excess phase error, thus allowing a lower clock frequency to be used.

The invention provides a switched current bilinear integrator comprising first and second interconnected current memory cells, means for feeding an input current to be integrated to the inputs of the current memory cells during a first portion of a cycle of a clock signal, means for feeding an inverted version of the input current to the inputs of the current memory cells during a second portion of a cycle of the clock signal, means for combining the output current of the first current memory cell with an inverted version of the output current of the second current memory cell, and means for deriving the integrated input current from the output of the combining means.

By continually sampling the input current and the output current the integrator according to the invention enables an effective doubling of the clock frequency, that is output samples occur every half cycle of the basic clock period. This is in contrast to the switched current bilinear z-transform integrators disclosed in the Toumazou, Hughes and Battersby reference where the output is held constant for a full clock cycle and to the Song and Roberts reference where the input is only sampled during the first half cycle of a clock period.

BRIEF DESCRIPTION OF THE DRAWING

Embodiments of the invention will now be described, by way of example, with reference to the accompanying drawings, in which.

DESCRIPTION OF THE PREFERRED EMBODIMENTS

Figure 1:
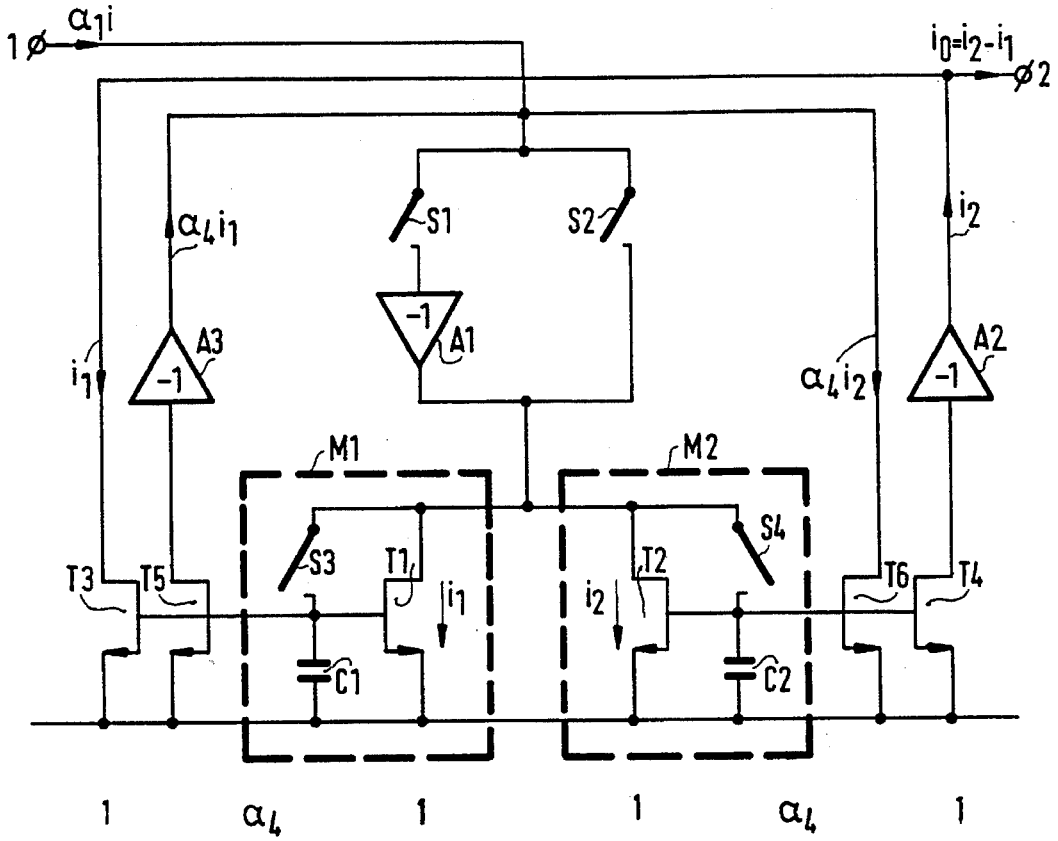
FIG. 1 is a schematic diagram of a bilinear z-transform integrator according to the invention.

FIG. 1 shows in schematic form a bilinear z-transform integrator according to the invention. It is purely a schematic diagram and does not include bias currents which would normally, as is well known, be included in practice to enable bidirectional currents to be handled and includes current inverters to invert the signal currents. These current inverters are present for ease of understanding and are not required in a fully differential structure as is explained hereinafter.

As shown in FIG. 1, an input 1 is connected to the junction of two switches S1 and S2. The other side of switch S2 is connected to the drain electrodes of first and second field effect transistors T1 and T2, while the other side of switch S1 is connected via a current inverter A1 to the junction of the drain electrodes of the transistors T1 and T2. The transistors T1 and T2 form a part of respective memory cells M1 and M2. These memory cells are completed by switches S3 and S4 and by capacitors C1 and C2, respectively. The gate electrode of transistor T1 is connected to the gate electrode of a transistor T3 while the gate electrode of transistor T2 is connected to the gate electrode of a transistor T4. The drain electrode of transistor T4 is connected via a current inverter A2 to the drain electrode of transistor T3 and to an output 2. The gate electrode of transistor T1 is further connected to the gate electrode of a transistor T5 whose drain electrode is connected via a current inverter A3 to the junction of switches S1 and S2. The gate electrode of transistor T2 is further connected to the gate electrode of a transistor T6 whose drain electrode is connected to the junction of switches S1 and S2. The switches S1 and S4 are closed when the clock signal $\phi$1 is high while the switches S2 and S3 are closed when the clock signal $\phi$2 is high.

The core of the integrator shown in FIG. 1 comprises the well known loop of interconnected memory cells M1 and M2 with the output of one of the memory cells mirrored to the output 2. It is modified, however, by combining the output of the other of the current memory cells in an inverted form to give the output of the integrator. Thus, the output will change on both odd and even half cycles of the clock period. Damping can be effected by mirroring the output currents in the memory transistors with weights $\alpha_4$ and feeding the resulting signal with appropriate polarity to the input node. Thus, both ideal and lossy integrators can be achieved by appropriately setting the value of $\alpha_4$. That is, if $\alpha_4$ is equal to 0 an ideal integrator is produced.

An analysis of the operation of the integrator gives the following relationships On odd clock half cycles (n−1)

$$i_2(n-1)=\alpha_1 i(n-1)-i_1(n-1)-\alpha_4 i_2(n-1)+\alpha_4 i_1(n-1)=i_2(n) \quad (1)$$

On even clock half cycles (n)

$$i_1(n)-i_2(n-1)+\alpha_4 i_2(n)-\alpha_4 i_2(n) \quad (2)$$

From (1) and (2)

$$\begin{aligned} io(n) &= i_2(n)-i_1(n) \quad (2) \\ &= \alpha_1\,[i(n)-i(n-1)]+i_0(n-1)- \\ &\quad \alpha_4[i_0(n)+i_0(n-1)] \end{aligned}$$

Taking z-transforms, where $z=e^{jwt}$, and re-arranging $$H(z)=\frac{i_0(z)}{i(z)}=\frac{\dfrac{\alpha_1}{1+\alpha_4}(1+z^{-1})}{1-\dfrac{1-\alpha_4}{1+\alpha_4}z^{-1}} \quad (3)$$

$$H(e^{j\omega T})=\frac{\alpha 1/\alpha_4}{1+j\dfrac{1}{\alpha_4}\tan\dfrac{\omega T}{Z}} \quad (4)$$

$$a0=\alpha 1/\alpha_4 \quad (5)$$

$$W_0=\frac{2}{T}\tan^{-1}(\alpha_4)$$

With $\alpha_4$ set to zero, the integrator is undamped. With $\alpha_4$ at a non-zero value, damping occurs and a first order low pass section results with low frequency gain $\alpha_0$ and a 3dB cut-off frequency $W_0$. These values are given by equation (5).

Figure 2:
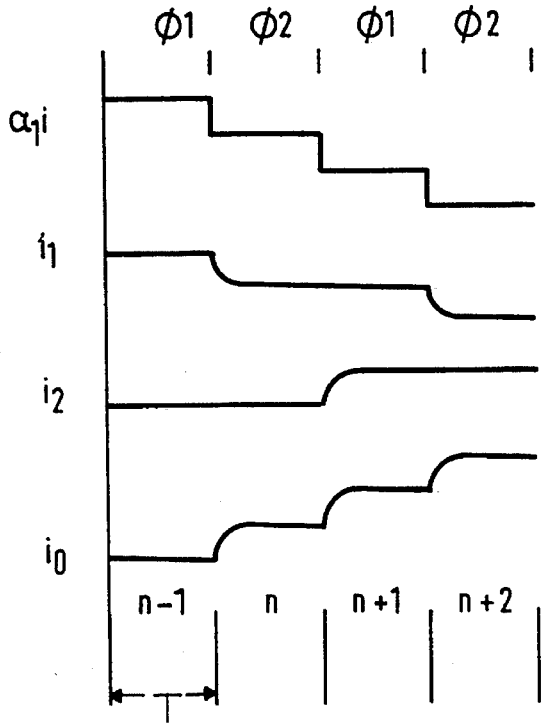
FIG. 2 illustrates waveforms occurring within the integrator shown in FIG. 1.

FIG. 2 gives the waveforms of the input current $\alpha_1 i$, the currents $i_1$ and $i_2$ in memory cells M1 and M2, and the output current $i_0$.

Figure 3:
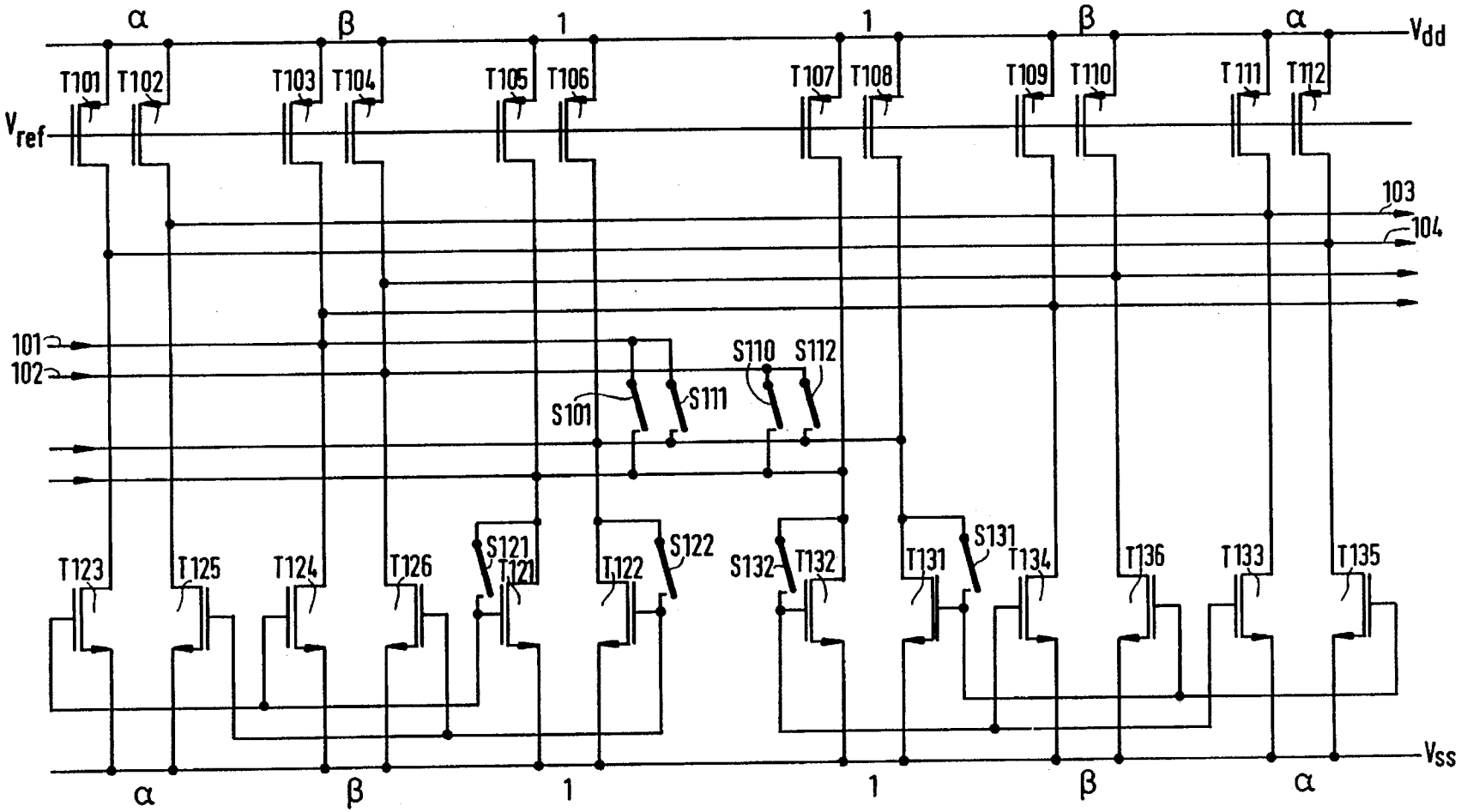
FIG. 3 shows a balanced version of the integrator shown in FIG. 1.

FIG. 3 shows a fully differential version of a bilinear z-transform integrator which performs the same algorithm as expressed in the analysis of the circuit of FIG. 1, but with signal current inversions achieved simply by crossing over the signal pairs. P-channel MOS transistors T101 to T112 have their source electrodes connected to a positive supply rail Vdd and their gate electrodes connected to a reference voltage Vref. As is well known in switched current circuits, these transistors form constant current sources which produce a bias current to enable bidirectional input signals to be handled. A differential input current 1 is fed on input lines 101 and 102. The line 101 is connected to one side of two switches S101 and S111 while the line 102 is connected to the junction of two switches S102 and S112. The other side of switch S101 is connected to the junction of the drain electrode of transistor T105 and the drain electrode of an n-channel MOS transistor T121 and to one side of a switch S121. The other side of switch S121 is connected to the gate electrode of transistor T121. The other side of switch S101 is also connected to the junction of the drain electrode of transistor T107 and the drain electrode of an n-channel MOS transistor T132. A switch S132 is connected between the drain and gate electrodes of transistor T132. The other side of switch S111 is connected to the junction of the drain electrode of transistor T106 and the drain electrode of a transistor T122. A switch S122 is connected between the drain and gate electrodes of transistor T122. The other side of switch S111 is also connected to the junction of the drain electrode of transistor T108 and the drain electrode of an n-channel MOS transistor T131. The drain and gate electrodes of transistor T131 are connected via a switch S131. In addition the other side of switch S111 is connected to the other side of switch S112 while the other side of switch S101 is connected to the other side of switch S110. The transistors T121 and T122 together with switches S121 and S122 and the gate source capacitance of the transistors T121 and T122 form a first current memory cell M1 which is a differential form of the current memory M1 shown in FIG. 1. Similarly, the memory circuit M2 is formed by transistors T131 and T132, switches S131 and S132 and the gate source capacitances of transistors T131 and T132.

It will be apparent to the person skilled in the art that the switching arrangement S101, S110, S111, S112 and the two differential inputs 101 and 102 are equivalent to the switches S1, S2 and the current inverter A1 of FIG. 1. Thus the inversion function of A1 is performed by the changeover of the connections between the input lines 101 and 102 and the inputs of the respective current memories M1 and M2. The current in transistor T121 is mirrored by an n-channel MOS transistor T124 whose drain electrode is connected to the drain electrode of transistor T103 and also to the line 101. The current in transistor T132 is mirrored by an n-channel MOS transistor T134 whose drain electrode is connected to the drain electrode of transistor T109, the junction of the two drain electrodes being connected to the line 101. The current in transistor T121 is further mirrored by an n-channel MOS transistor T123 whose drain electrode is connected to the drain electrode of transistor T101, the junction of the two drain electrodes being connected to an output 104. Similarly the current in transistor T132 is mirrored by an n-channel MOS transistor T133 whose drain electrode is connected to the drain electrode of transistor T111 and to an output 103. In a similar manner the current through transistor T122 is mirrored by an n-channel MOS transistor T126 whose drain electrode is connected to the drain electrode of transistor T104, the junction of the two drain electrodes being connected to line 102. The current in transistor T122 is also mirrored by an n-channel MOS transistor T125 whose drain electrode is connected to the drain electrode of transistor T102, the junction of the two drain electrodes being connected to an output 103. The current in transistor T132 is also mirrored in a transistor T133 whose drain electrode is connected to the drain electrode of the transistor T111, the junction of the two drain electrodes being connected to output 103. The current in transistor T131 is mirrored by an n-channel MOS transistor T135 whose drain electrode is connected to the drain electrode of the transistor T112 and to output 104. The current in transistor T131 is also mirrored in an n-channel MOS transistor T136 whose drain electrode is connected to the drain electrode of transistor T110, the junction of the two drain electrodes being connected to line 102.

As can be seen from a consideration of the circuit of FIG. 3, it is the differential equivalent of the circuit of FIG. 1. The transistors T123 and T125 are the equivalent of the transistor T3 in FIG. 1 while the transistors T133 and T135 are the equivalent of the combination of transistor T4 and inverter A2 of FIG. 1, the factor a giving the overall gain of the integrator. Similarly, the transistor T124 and T126 are the equivalent of the transistors T5 and the current inverter A3 while the transistors T133 and T136 are the equivalent of transistor T6, the factor β being equivalent to the factor $\alpha_4$ in FIG. 1. This is achieved merely by reversing connections as in the differential circuit the true and inverted versions of the current are always available and can be selected merely by choosing the right connections.

Figure 4:
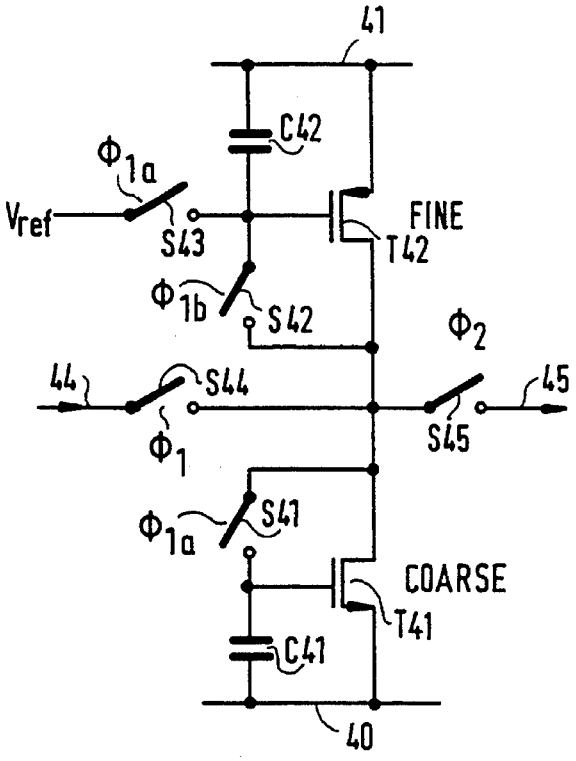
FIG. 4 shows a two step current memory cell which may be used in the integrator of FIG. 1 or FIG. 3.
Figure 5:
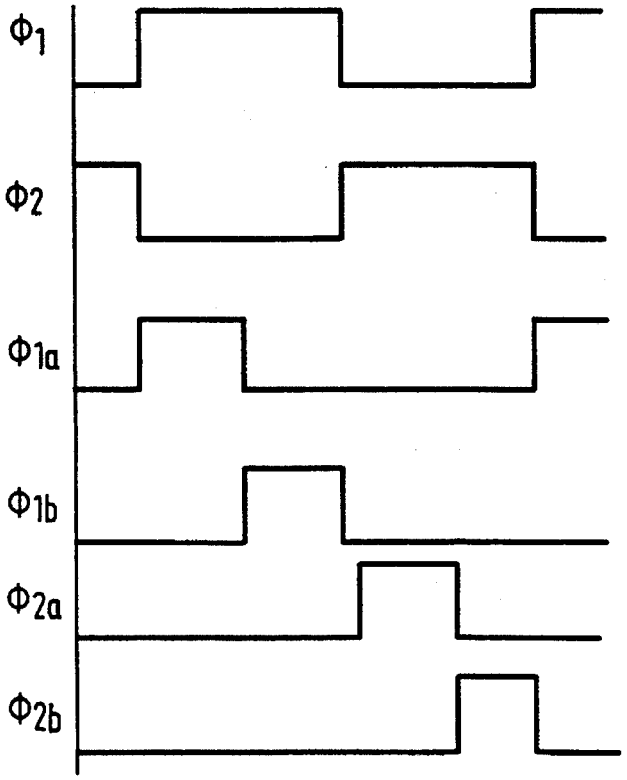
FIG. 5 shows clock waveforms associated with the current memory shown in FIG. 4.

FIG. 4 shows a current memory circuit which is an improvement on the current memory circuit shown in FIG. 1. FIG. 5 shows the various clock waveforms used in the current memory of FIG. 4.

The current memory shown in FIG. 4 comprises a first n-channel field effect transistor T41 which has its source electrode connected to a negative supply rail 40 and its drain electrode connected to the drain electrode of a p-channel field effect transistor T42 whose source electrode is connected to a positive supply rail 41. A capacitor C41 is connected between the gate and source electrodes of transistor T41 while a switch S41 is connected between the drain and gate electrodes of transistor T41. Similarly, a capacitor C42 is connected between the source and gate electrodes of transistor T42 while a switch S42 is connected between the gate and drain electrodes of transistor T42. An input 44 is connected via a switch S44 to the junction of the drain electrodes of transistors T41 and T42. An input 43 to which a reference voltage Vref is applied is connected via a switch S43 to the gate electrode of transistor T42. A switch S45 is connected between the junction of transistors T42 and T41 and an output 45. As shown in FIG. 5 there is a master clock which has two phases ϕ1 and ϕ2. The switch S44 is closed on phase ϕ1 while the switch S45 is closed on phase ϕ2. That is the input is sampled on phase ϕ1 and the output is produced on phase ϕ2. In addition there is a double frequency clock which gives phases ϕ1*a*, ϕ1*b*, ϕ2*a*, ϕ2*b*. Switches S41 and S43 are closed during phase ϕ1*a* while switch S42 is closed during phase ϕ1 *b*.

The process of storing the sampled and held input current i which is applied to input 44 is made into two steps. The first is a coarse step in which the input sample is stored approximately in a coarse memory CM which comprises transistor T41, switch S41 and capacitor C41. This is followed by a fine step during which the error of the coarse step is derived and stored in the memory CF which comprises transistor T42, capacitor C42 and switch S42. The output is then delivered in phase ϕ2 from both memory cells so that the coarse error is subtracted to leave an accurate memory of the input sample. The input phase ϕ1 is divided into two phases ϕ1*a* and ϕ1*b* during which the coarse and then fine storing steps occur. During phase ϕ1*a* the transistor T42 has its gate electrode connected to Vref and generates a bias current j. The current in the diode connected transistor T41 is then j+i. At the end of phase ϕ1*a* the coarse memory switch S41 is opened and the transistor T41 holds a current j+i+Δi, where Δi is the signal dependent error current resulting from all the usual errors associated with the basic switched current memory cell. During phase ϕ1*b* the transistor T42 is configured as a diode and with the signal current i still flowing at the cell's input, its drain current settles towards the current j+Δi. At the end of phase ϕ1*b*, since Δi is very much less than j, the voltage at the two transistor drains is close to the value with no signal present, that is the circuit develops a voltage at the drain electrodes of both memory transistors which is akin to a virtual ground.

During phase ϕ2 the gate of transistor T42 is opened and an extra error δi occurs in the fine memory mainly due to charge injection. If the output is fed to a second cell of similar type, the second cell establishes a similar virtual ground voltage at its input during phase ϕ2*b*. The drains of the first cell's memories are therefore held at nearly the same voltage at the end of both input and output phases, a condition established by negative feedback in conventional cells and which gives a much reduced conductance ratio error. Further, because the current in the fine memory transistor and the voltage on its switch are similarly constant during these phases the charge injection error of the fine memory is much reduced.

Even though the clock phases ϕ1 and ϕ2 are subdivided into a and b phases, this does not double the required transistor bandwidths as the settling error on the a phase is transmitted to the transistor T42 where settling may continue on the b phase.

Figure 6:
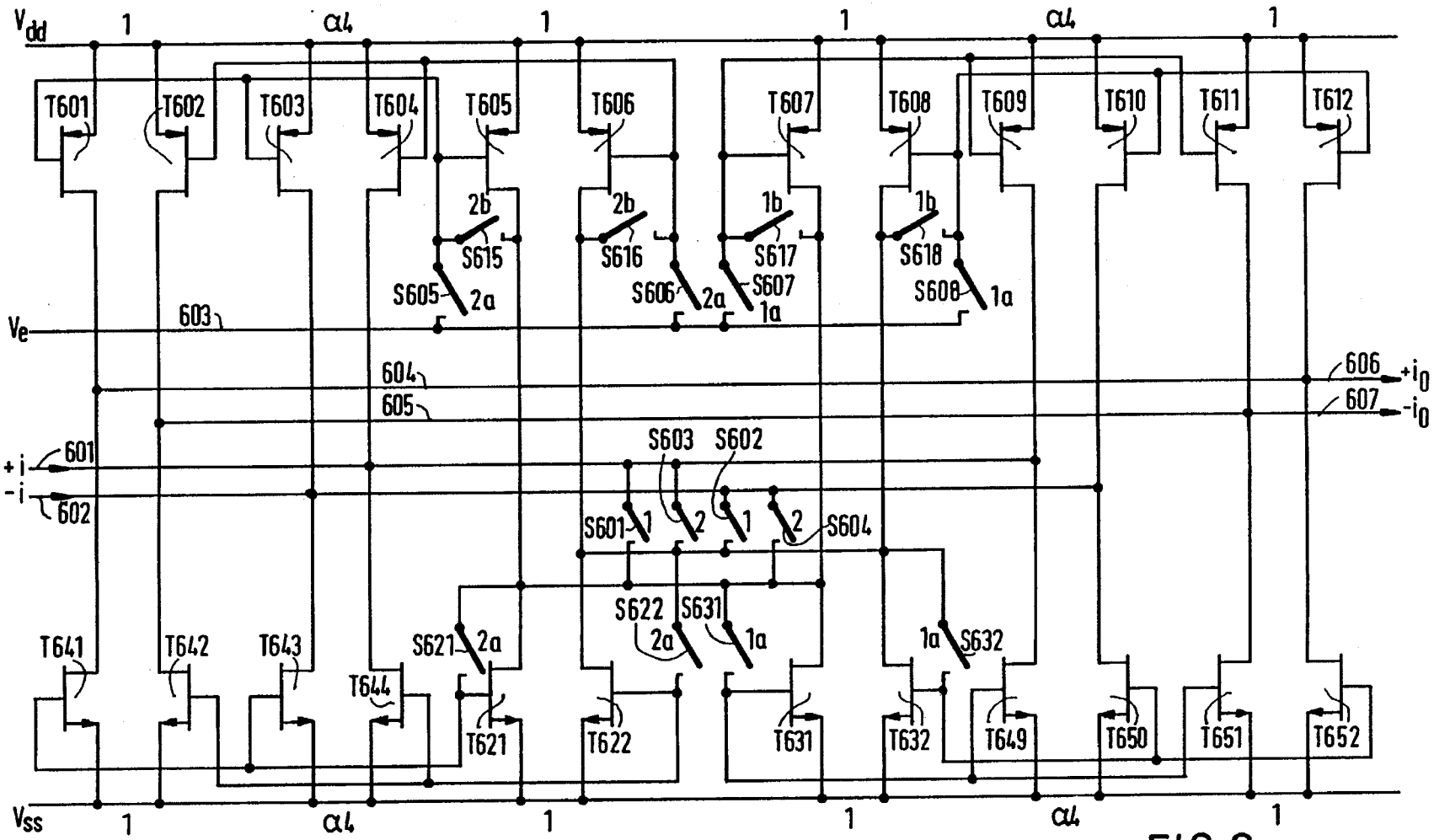
FIG. 6 shows a bilinear z-transform integrator using the current memory cell shown in FIG. 4.

FIG. 6 shows a bilinear z-transform integrator of the same form as that shown in FIG. 3 but with the basic current memory cell replaced by the enhanced current memory cell shown in FIG. 4.

As shown in FIG. 6 twelve p-channel field effect transistors T601 to T612 have their source electrodes connected to a supply rail Vdd. A line 601 is connected via a switch S601 to the drain electrodes of two n-channel field effect transistors T621 and T631. A switch S621 is connected between the drain and gate electrodes of transistor T621 while a switch S631 is connected between the drain and gate electrodes of transistor T631. A second line 602 is connected via a switch S602 to the drain electrodes of two n-channel field effect transistors T622 and T632. A switch S622 is connected between the drain and gate electrodes of transistor T622 while a switch S632 is connected between drain and gate electrodes of transistor T632. A further switch S603 is connected between the line 601 and the drain electrodes of transistors T632 and T622 while a switch S604 is further connected between the line 602 and the drain electrodes of transistors T621 and T631.

A line 603 carrying a reference voltage Vref is connected to one side of four switches S605 to S608. The other side of switch S605 is connected to the gate electrodes of transistors T605, T603 and T601 while the other side of switch S608 is connected to the gate electrodes of transistors T608, T610 and T612. The other side of switch S606 is connected to the gate electrodes of transistors T606, T604 and T602 while the other side of switch S607 is connected to the gate electrodes of transistors T607, T609 and T611. Four further switches S615 to S618 are connected between the drain and gate electrodes of transistors T605 to T608 respectively. The drain electrode of transistor T605 is connected to the drain electrode of transistor T621 while the drain electrode of transistor T606 is connected to the drain electrode of transistor T622. Further, the drain electrode of transistor T607 is connected to the drain electrode of transistor T631 while the drain electrode of transistor T608 is connected to the drain electrode of transistor T632.

The gate electrode of transistor T621 is connected to the gate electrodes of transistors T641 and T643 while the gate electrode of transistor T622 is connected to the gate electrode of two n-channel field effect transistors T642 and T644. The gate electrode of transistor T631 is connected to the gate electrodes of two n-channel field effect transistors T649 and T651 while the gate electrode of transistor T632 is connected to the gate electrodes of two n-channel field effect transistors T650 and T652. The source electrodes of transistors T621, T622, T631, T632, T641 to T644 and T649 to T652 are connected to a supply rail Vss.

The drain electrodes of transistors T601 to T604 are connected to the drain electrodes of transistors T641 to T644, respectively. The junction of the drain electrodes of transistors T603 and T643 is connected to the line 602 while the junctions of the drain electrodes of the transistors T604 and T644 are connected to the line 601. Similarly, the junctions of the drain electrodes of transistors T601 and T641 are connected to a line 604 while the junctions of the drain electrodes of transistors T602 and T642 are connected to a line 605. Similarly the drain electrodes of transistors T609 to T612 are connected to the drain electrodes of transistors T649 to T652 respectively. The junctions of the drain electrodes of transistors T609 and T649 are connected to the line 601 while the junctions of the drain electrodes of transistors T610 and T650 are connected to the line 602. In addition the junctions of the drain electrodes of the transistors T611 and T651 are connected to the line 605 while the junctions of the drain electrodes of transistors T612 and T652 are connected to the line 604. The line 604 is connected to an output 606 while the line 605 is connected to an output 607. The drain electrode of transistor T605 is connected to the drain electrode of the transistor T621, the drain electrode of transistor T606 is connected to the drain electrode of transistor T622, the drain electrode of transistor T607 is connected to the drain electrode of transistor T631 and the drain electrode of the transistor T608 is connected to the drain electrode of transistor T632.

Using the waveforms of FIG. 5, switches S601 and S602 are closed when the phase $\phi 1$ is high and switches S603 and S604 are closed when the phase $\phi 2$ is high. Switches S605 and S606 are closed when the phase $\phi 2a$ is high and switches S607 and S608 are closed when the phase $\phi 1a$ is high. Switches S615 and S616 are closed when phase $\phi 2b$ is high while S617 and S618 are closed when phase $\phi 1b$ is high. Switches S621 and S622 are closed when phase $\phi 2a$ is high while switches S631 and S632 are closed when phase $\phi 1a$ is high. Transistors T605, T606 T621 and T622 together with their associated switches form a first differential current memory cell formed from current memory cells shown in FIG. 4. Transistors T607, T608, T631, T632 and their associated switches likewise form a differential current memory cell of the same form.

It will be seen that during phase $\phi 1a$ the input current +i on line 601 is fed to the drain electrode of transistor T631 and the switch S631 is closed so that the transistor T631 is diode connected. In addition switch S607 is closed and consequently the reference voltage Ve on line 603 is applied to the gate electrode of the transistor T607 causing it to produce a reference bias current. Thus, transistor T631 senses the reference bias current produced by transistor T607 during phase $\phi 1a$, the input current applied to input 601 and the output current of the current memory cell comprising transistors T605 and T621 and switches S615 and S621. Similarly the transistor T632 receives the current applied to input 602, the reference current produced by transistor T608 during the phase $\phi 1a$ and the output current of the current memory cell comprising transistors T606 and T622 and switches S616 and S622. At the end of phase $\phi 1a$ switches S631 and S632 and also switches S607 and S608 are opened. Due to the gate-source capacitance of transistors T631 and T632 they continue to pass the same current as was passed at the end of the phase $\phi 1a$ during the phase $\phi 1b$. At phase $\phi 1b$ switches S617 and S618 close and transistors T607 and T608 sense the input currents ±i on line 601 and 602 respectively and the current through transistors T631 and T632 and the outputs of the other current memory cells. Thus the transistors T607 and T608 sense the difference between the input currents and the currents produced by transistors T631 and T632 and the other current memory cells.

As will be seen, the transistors T631 and T632 store a coarse replica of the input currents on line 601 and 602 and the output currents of the other current memory cells while the transistors T607 and T608 sense the difference between that coarse replica and the input current and output currents of the other current memory cells during the phase $\phi 1b$. At the end of phase $\phi 1b$ the switches S617 and S618 open and consequently the transistors T607 and T608 will produce the current that has been sensed because of the charge on their gate-source capacitors. The current through transistor T631 is mirrored by transistor T651 while the current through transistor T607 is mirrored by transistor T617. Thus the current on line 601 combined with the current produced by the current memory cell comprising transistors T606 and T621 is stored in the current memory comprising transistors T631 and T607 and the stored output is mirrored to the output 607. Consequently merely by changing the connections the positive input current on line 601 and the output current produced by the current memory cell comprising transistors T606 and T621 is memorised and fed via the current mirrors T651 and T617 to the negative output 607 thus performing the inversion of the input signal. This is equivalent to the current inverter A2 of FIG. 1. Similarly the transistors T632 and T608 store the input current on line 602 combined with the current produced by the current memory cell comprising transistors T606 and T622 and their stored currents are mirrored by transistors T612 and T652 to output 606. This again is an effective inversion of the stored input signal.

During phase $\phi 2$ the input current on line 601 combined with the current produced by the current memory cell comprising transistors T608 and T632 is sensed and stored by the current store comprising transistors T622 and T606 together with their associated switches. Similarly the input current on line 602 combined with the current produced by the current memory cell comprising transistors T607 and T631 is stored by transistors T621 and T605 and their associated switches. As the currents applied to this current memory are changed over in polarity with respect to those applied to the current memory comprising transistors T631 and T632 this switching network is equivalent to the current inverter A1. The current stored by transistors T621 and T605 are mirrored in transistors T601 and T641 and applied to the output 606 via the line 604. The current stored by the transistors T622 and T606 are mirrored by transistors T642 and T602 and fed via the line 605 to the output 607. Thus it will be apparent in this case there is no inversion from the outputs of the current memory cell to the outputs 606 and 607.

In order to produce a lossy integrator the output of the current memory cells formed by transistors T621, T622, T605 and T606 are fed back via the current mirror outputs from transistors T603 and T643 and T604 and T644. These current mirrors have an amplicification factor of $\alpha_4$ which determines the characteristic of the integrator. It will be seen that the outputs of these mirrors are effectively inverted by means of the connections to the lines 601 and 602 and hence this provides the function provided by the current inverter A3 in FIG. 1. Similarly the outputs of the current memory cell provided by transistors T607, T631, T608 and T632 are mirrored via transistors T609, T649, T610 and T650 to the inputs, but in this case without an inversion.

Thus it can be seen from FIGS. 3 and 6 that a differential form of the integrator shown in FIG. 1 can be achieved and that the current inverters A1, A2 and A3 are not required in the differential form as it is possible to merely cross over the connections of the differential outputs to produce the inverting functions.

It will be seen that the integrator as disclosed herein enables an effective doubling of the clock frequency since the input is sampled on both the odd and even phases of the clock and that the output changes as each clock phase changes. Thus there is an effective doubling of the frequency at which the output of the integrator changes. This of course means that the double frequency clock required for the current memory cells as disclosed in FIG. 4 remains at the same frequency as the clock frequency for the simple cell in the prior art integrators. As a result either by using the prior art current memory cells the effective clock frequency can be doubled or by using the enhanced current memory cells as shown in FIG. 4 the sub-phase clock or $\phi 1a$ and $\phi 1b$, $\phi 2a$ and $\phi 2b$ is at the same frequency that the clock for the simple current memory cell would otherwise have been. Consequently, the principle of sampling the input current on one phase of the clock signal and an inverted version of the input signal on the other phase of the input clock signal enables an effective doubling of the clock frequency. In a single ended integrator this requires the insertion of a number of current inverters, but with a differential structure the current inverters can be replaced by merely selecting and changing over the differential outputs and inputs.

While two versions of current memory have been disclosed in the embodiments of the inverter, that is the simplest form as shown in FIG. 1 and the more complex form shown in FIG. 4, any other form of current memory cell could be substituted and the same principles would apply. A number of such other current memory cells are disclosed in chapter 6 of the book entitled "Switched Currents—An Analogue Technique for Digital Technology" edited by C. Toumazou, J. B. Hughes and N. C. Battersby published by Peter Peregrinus Ltd. 1993.

From reading the present disclosure, other modifications will be apparent to persons skilled in the art. Such modifications may involve other features which are already known in the field of sampled analogue circuits and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly, whether or not it relates to the same invention as presently claimed in any claim and whether or not it mitigates any or all of the same technical problems as does the present invention.

We claim:

1. A switched-current bilinear integrator comprising: first and second interconnected current memory cells, means for feeding an input current to be integrated to respective inputs of the current memory cells during a first portion of a cycle of a clock signal, means for feeding a version of the input current of opposite polarity to the inputs of the current memory cells during a second portion of the cycle of the clock signal, means for producing a version of an output current of the second current memory cell of opposite polarity, means for combining an output current of the first current memory cell with the version of the output current of the second current memory cell of opposite polarity, and means for deriving an integrated input current from an output of the combining means.

2. A switched current bilinear integrator as claimed in claim 1 wherein each of the first and second current memory cells further comprise a current mirror circuit with an output of each current mirror circuit being fed to the combining means.

3. An integrator as claimed in claim 2 in which the current mirror circuit in the first current memory has a further output, said further output being fed in a form having opposite polarity to that stored in the first current memory to the input of the integrator and the current mirror circuit in the second current memory has a further output which is fed to the input of the integrator.

4. An integrator as claimed in claim 1 wherein the first and second portions of the clock signal each comprise first and second subportions and each of the current memory cells has a coarse current sensing cell which senses the input current at the current memory cell input during the first subportion of one portion of the clock signal and a fine current sensing cell which senses differences between the input current and an output current produced by the coarse current sensing cell during the second subportion, and the means for combining combines output currents of the coarse and fine current sensing cells during a further portion of the clock cycle to output a stored current.

5. A switched current bilinear integrator having differential inputs and outputs comprising first and second integrators each as claimed in claim 4, further comprising switching means for selectively interconnecting the differential inputs to the current memory cells during the first and second portions of the clock cycle and by selectively connecting the outputs of the current memory cells to the differential outputs during the first and second portions of the clock cycle thereby to derive the currents of opposite polarity.

6. An integrator as claimed in claim 2 wherein the first and second portions of the clock signal each comprise first and second subportions and each of the current memory cells has a course current sensing cell which senses the input current at the input of said current memory cell during the first subportion of one portion of the clock signal and a fine current sensing cell which senses differences between the input current and an output current produced by the coarse current sensing cell during the second subportion, and the means for combining combines output currents of the coarse and fine current sensing cells during a further portion of the clock cycle to output a stored current.

7. A switched current bilinear integrator having differential inputs and outputs comprising first and second integrators each as claimed in claim 1, further comprising switching means for selectively interconnecting the differential inputs to the current memory cells during the first and second portions of the clock cycle and by selectively connecting the outputs of the current memory cells to the differential outputs during the first and second portions of the clock cycle thereby to derive the currents of opposite polarity.

8. A switched current bilinear integrator having differential inputs and outputs comprising first and second integrators each as claimed in claim 2, further comprising switching means for selectively interconnecting the differential inputs to the current memory cells during the first and second portions of the clock cycle and by selectively connecting the outputs of the current memory cells to the differential outputs during the first and second portions of the clock cycle thereby to derive the currents of opposite polarity.

9. A switched-current bilinear integrator comprising:

first and second interconnected current memory cells each having an input and an output, an input terminal for supplying to the integrator an input current to be integrated, switching means for selectively coupling said input terminal to the inputs of the first and second current memory cells so as to supply thereto the input current and an inverted form of said input current during respective first and second portions of a cycle of a clock signal, and means for combining an output current of the first current memory cell with an inverted form of an output current of the second current memory cell thereby to produce at an output of the combining means an output current which is an integrated version of the input current at said input terminal.

10. The switched current bilinear integrator as claimed in claim 9 wherein said switching means comprises a first switching device connecting said input terminal to the inputs of the first and second current memory cells and a series circuit including a second switching device and a current inverter connecting said input terminal to the inputs of the first and second current memory cells.

11. The switched current bilinear integrator as claimed in claim 10 wherein said combining means comprises:

first means for coupling the output of the first current memory cell to an output terminal of the integrator and a second current inverter for coupling the output of the second current memory cell to the output terminal of the integrator, and second means for coupling the output of the second current memory cell to the input terminal and a third current inverter for coupling the output of the first current memory cell to the input terminal.

12. The switched current bilinear integrator as claimed in claim 9 wherein each of said current memory cells comprise:

a field effect transistor connected between the input of its current memory cell and a point of reference voltage, a capacitance connected between a control electrode of the associated field effect transistor and said point of reference voltage, and a switching device operated in synchronism with said switching means and connected between the input of its current memory cell and said control electrode of the associated field effect transistor.

13. The switched current bilinear integrator as claimed in claim 12 wherein said combining means comprises:

a second field effect transistor coupled to the field effect transistor of the first current memory cell so as to form therewith a first current mirror circuit having its output coupled to said output terminal, a third field effect transistor coupled to the field effect transistor of the second current memory cell so as to form therewith a second current mirror circuit having its output coupled to said output terminal via a first current inverter, a fourth field effect transistor coupled to the field effect transistor of the first current memory cell so as to form therewith a third current mirror circuit having its output coupled to said input terminal via a second current inverter, and a fifth field effect transistor coupled to the field effect transistor of the second current memory cell so as to form therewith a fourth current mirror circuit having its output coupled to said input terminal.

14. The switched current bilinear integrator as claimed in claim 12 wherein said switching means comprises a first switching device connecting said input terminal to the inputs of the first and second current memory cells and a series circuit including a second switching device and a current inverter connecting said input terminal to the inputs of the first and second current memory cells, and wherein said clock signal causes said first switching device and the switching device of the first current memory cell to be closed in a same first time period and said second switching device and the switching device of the second current memory cell to be closed in a second same time period different from said first time period.

15. The switched current bilinear integrator as claimed in claim 9 wherein said first and second current memory cells are connected in parallel between said switching means and a common terminal of said integrator.

16. A differential switched current bilinear integrator comprising:

first and second input terminals for supplying to the integrator differential input currents, first and second differential output current terminals of the integrator, a first current memory circuit including first and second current memory cells each having an input and an output, a second current memory circuit including third and fourth current memory cells each having an input and an output, means for coupling said first and second output current terminals to respective outputs of the current memory cells, and switching means coupling said first and second input terminals to respective inputs of the current memory cells so as to change over the connections between the input terminals and the inputs of the current memory cells in a manner so as to produce a current inversion function between first and second phases of a clock cycle of a clock signal that controls the operation of said switching means.

17. The differential switched current bilinear integrator as claimed in claim 16 wherein said switching means comprises:

a first switching device coupled between said first input terminal and respective inputs of the first and third current memory cells, a second switching device coupled between said first input terminal and respective inputs of the second and fourth current memory cells, a third switching device coupled between said second input terminal and respective inputs of the first and third current memory cells, and a fourth switching device coupled between said second input terminal and respective inputs of the second and fourth current memory cells.

18. The differential switched current bilinear integrator as claimed in claim 16 wherein each of said current memory cells is connected in a separate series circuit with a respective current source to a source of DC supply voltage.

19. The differential switched current bilinear integrator as claimed in claim 18 wherein each of said current memory cells is coupled via respective current mirror circuits to respective ones of said input and output terminals.

20. The differential switched current bilinear integrator as claimed in claim 18 wherein each of said current memory cells comprises:

a field effect transistor connected in said separate series circuit with its respective current source, a switching device connecting a gate electrode of the field effect transistor to one of its main electrodes, and a capacitance coupled between said gate electrode and the other main electrode of the field effect transistor.

* * * * *